US005165116A

United States Patent [19]

Simpson

[11] Patent Number: 5,165,116

[45] Date of Patent: Nov. 24, 1992

[54] ANTI BUFFETING SAFETY-RACING HELMET

[76] Inventor: Elwood J. B. Simpson, P.O. Box 154, Alpine, Wyo. 83128

[21] Appl. No.: 775,580

[22] Filed: Oct. 15, 1991

Related U.S. Application Data

[63] Continuation of Ser. No. 584,778, Sep. 10, 1990, abandoned.

[51] Int. Cl.[5] ..... A42B 1/08

[52] U.S. Cl. ..... 2/424; 2/410

[58] Field of Search ..... 2/410, 411, 412, 414, 2/424, 422, 425

[56] References Cited

U.S. PATENT DOCUMENTS

| | | | |
|---|---|---|---|
| 4,075,714 | 2/1978 | Ryder et al. | 2/425 |
| 4,586,197 | 5/1986 | Hubbard | 2/410 |
| 4,622,700 | 11/1986 | Sundahl | 2/425 |
| 4,704,746 | 11/1987 | Nava | 2/424 |
| 4,903,350 | 2/1990 | Gentes et al. | 2/425 |

FOREIGN PATENT DOCUMENTS

| | | | |
|---|---|---|---|
| 131929 | 1/1985 | European Pat. Off. | 2/410 |
| 3305735 | 8/1984 | Fed. Rep. of Germany | 2/410 |
| 3316920 | 11/1984 | Fed. Rep. of Germany | 2/410 |
| 8703457 | 6/1987 | PCT Int'l Appl. | 2/424 |

*Primary Examiner*—Werner H. Schroeder
*Assistant Examiner*—Michael A. Neas
*Attorney, Agent, or Firm*—William H. Maxwell

[57] ABSTRACT

A safety helmet for racing characterized by a lift reducing stall-strip and air discharge slot supplying air from the ventilation space between the helmet shell and the wearer's head for discharge over the stall-strip so that buffeting by turbulent air at high velocity is reduced.

14 Claims, 2 Drawing Sheets

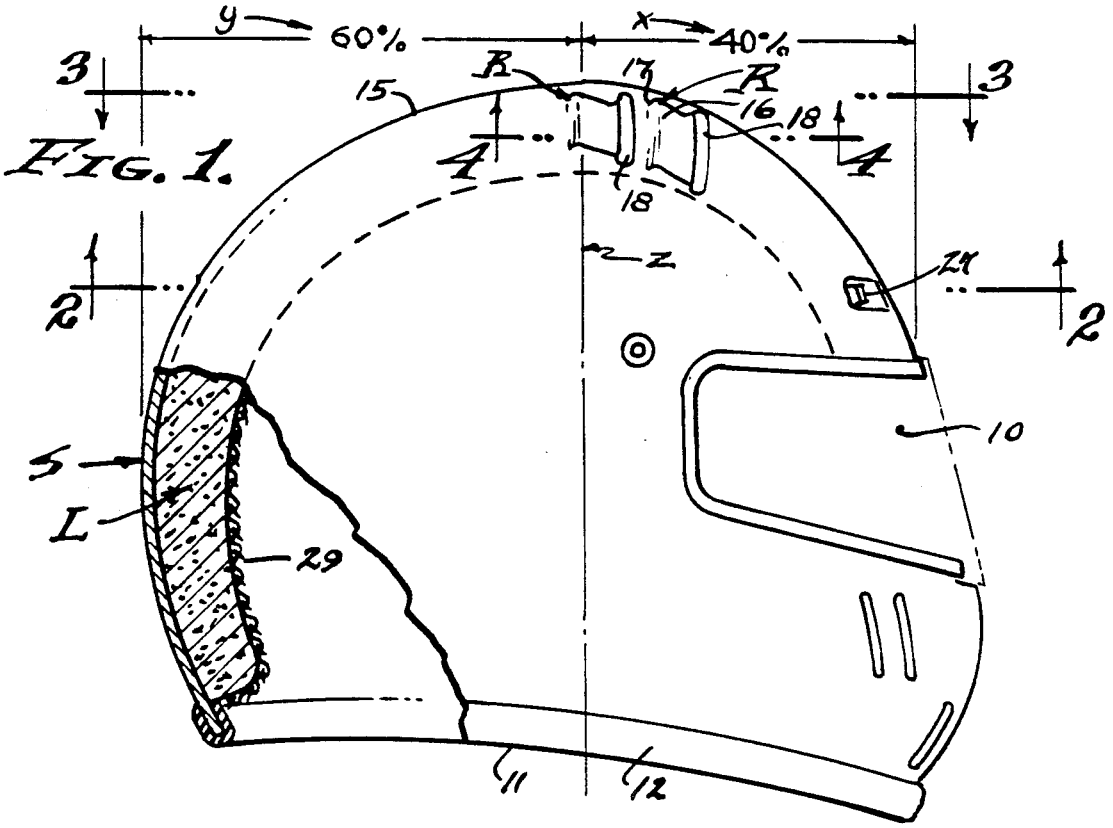
FIG. 1.
FIG. 2.
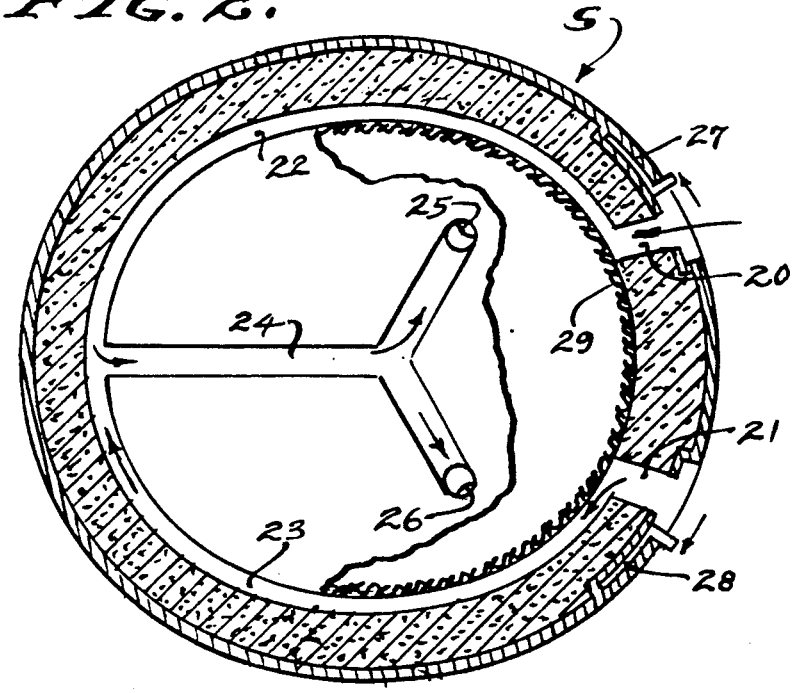

ANTI BUFFETING SAFETY-RACING HELMET

This application is a continuation of Ser. No. 07/584,778 filed Sep. 10, 1990, now abandoned.

BACKGROUND OF THE INVENTION

This invention relates to safety helmets used during high speed racing events with vehicles including motorcycles and race cars. At high speeds buffeting of the helmets occurs, which has required special strapping and tie-down features, so as to reduce movements of the helmets and to prevent their displacement on or from the wearer's head. The buffeting which has occured is characterized by irregular lift action as a result of aerodynamics, and resulting in jerking or jiggling motions that turn the helmet into unpredictable positions, it being a general object of this invention to provide aerodynamic features on the helmet per se, features that reduce and/or eliminate undesirable lift and detremental buffeting.

Safety helemts of the type under consideration are comprised of a shell of lightweight high impact resistant material such as a carbon fiber Kevlar® fiberglass composite material. It is customary to line the shell with a cushioning liner of shock absorbent material such as a molded inner shell of styrofoam interfaced with the interior of the outer shell and shaped to fit the head contours of the wearer. These helmets are of a so called "full face" design, completely shielding the face of the wearer, and with a transparent window widened for complete peripheral vision. In practice, the window is made of a substantially thick (0.125 inc.) Lexan® shield. As thus far described, the helmet covers the head of the wearer, with adequate ventilation betweath the wearer's chin and around the wearer's neck. However, ventilation over the forehead and scalp of the wearer tends to be inhibited, and to this end it is common practice to provide vent openings to induce flow-through ventilation. The aforesaid inner liner occupies the space between the helmet shell and the wearer's head and is provided with ducts that distribute air flow as may be required. It is an object of this invention to provide a helmet of the above description with air ducting in the liner and through the helmet shell to enhance the aerodynamics of the helmet, whereby undesirable lift and/or detremental buffeting is reduced and/or eliminated.

Present day open cockpit race cars travel at speeds up to and exceeding 200 m.p.h., at which speeds the air moving over the vehicle and its driver is quite turbulent. Firstly, the air flow over the cockpit is initially turbulent, which causes buffeting of the driver's helmet. And accordingly, the air flow over the helmet per se remains turbulent, which aggravates buffeting of the driver's helmet. The vehicle turbulence is attenuated as best as possible in the vehicle design, but buffeting of the prior art helmets persists. However, helmet buffeting is further attenuated by the present invention, it being an object of this invention to provide a stall strip in conjunction with a supply of interior air from between the helmet shell and the wearer's head, to reduce and/or eliminate helmet lift and buffeting. A characteristic feature of this invention is the stall strips that protrude from the helmet surface contour to control turbulence over the re-entry portion of the helmet, as will be described.

SUMMARY OF THE INVENTION

Lift is caused by the flow of air over the highly cambered fore and aft contour of the helmets herein described. This lift is aggravated by the irregular turbulence of air flow over a vehicle, especially race cars wherein the driver occupies an open cockpit over which the turbulent air velocitiy is at and upward of the 150 m.p.h. range. In order to reduce and/or eliminate lift and buffeting of the driver's helment under high speed conditions, stall strips are provided that protrude from the helmet surface, so as to destroy the normal air flow and thereby negate the irregular lift heretofore experienced. A feature that enhances the stall strip effect is the induced addition of interior air from the space between the helmet shell and wearer's head and to the boundary layer of air flowing from the entry portion of the helmet and over the re-entry portion. This additional air supply serves to fill the turbulent re-entry portion and eliminates lift that would otherwise occur due to an accelerated re-entry of air. Consequently, the aforesaid initial turbulence of the passing vehicle air has a reduced effect, and the helmet per se has little or no inherent lift. The result is a steadying effect heretofore unobtainable in ventilated safety helmets used under the conditions prescribed.

The foregoing and various other objects and features of this invention will be apparent and fully understood from the following detailed description of the typical preferred form and application thereof, throughout which descriptive reference is made to the accompanying drawings.

THE DRAWINGS

FIG. 1 is a side elevation of a safety helmet embodying the features of the present invention, a portion broken away to show cross-sectioning.

FIG. 2 is a sectional view taken as indicated by line 2—2 on FIG. 1.

PREFERRED EMBODIMENT

Figure 3:
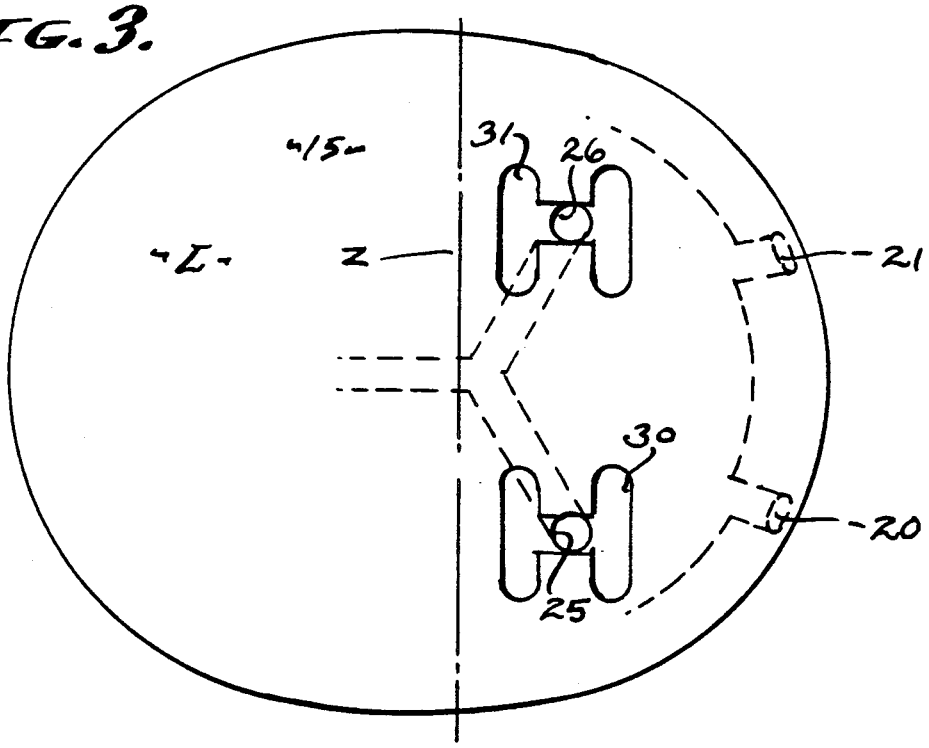
FIG. 3 is a plan view of the helmet liner taken as indicated by line 3—3 on FIG. 1, with the helmet shell removed.

Referring now to the drawings, this Safety-Racing Helmet involves, generally, a thin hard outer shell S and a thick soft inner liner L, the exterior of the latter being interfaced with the interior of the former. The helmet shown is of "full-face" design that completely covers the wearer's head, there being a full width window 10 at the front thereof to be closed by a protective transparent shield (not shown). The bottom 11 is open for the entry of the wearer's head, there being a protection bead 12 at the lowermost edge of the opening. For the purpose of orienting the aerodynamic features hereinafter disclosed, the helmet is to be considered as having a forwardly faced entry portion x, and a rearwardly trailing re-entry portion y. The maximum cross section of the helmet occurs at z in a vertical transverse plane, where the entry portion continues into the re-entry portion. A characteristic feature of this type helmet is that the longitudinal extent of the re-entry portion y exceeds that of the entry portion x. For example, 60% to 40%, approximately as shown.

In accordance with this invention, the aerodynamic stabilizing features exposed at the outer shell S are located at and preferably forward of the cross sectional plane z so as to occupy the entry portion x as it merges and/or continues into the re-entry portion y. As shown in FIG. 1, the top profile of the helmet shell S presents a high camber contour of diminishing curvature as it extends rearwardly. Since the shell S is of dome shaped configuration, as shown, the top is of compound curvature over which the turbulent vehicle air passes at high velocity. It is this high velocity air flow that is controlled with respect to the cambered surface of the helmet shell S.

Figure 4:
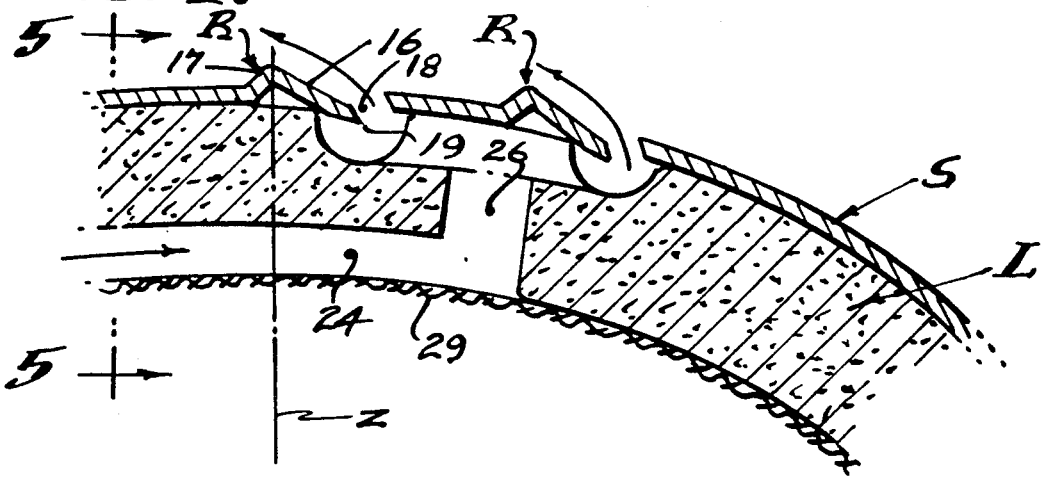
FIG. 4 is an enlarged detailed sectional view taken substantially as indicated by line 4—4 on FIG. 1.
Figure 5:
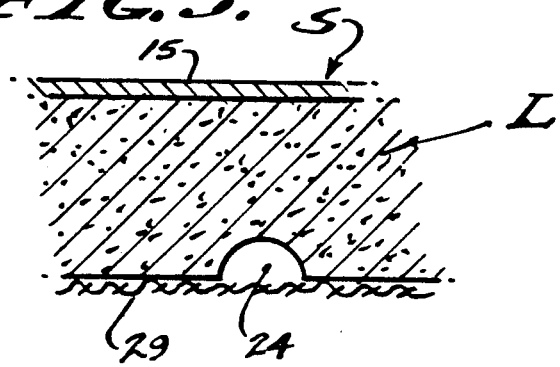
FIG. 5 is a fragmentary sectional view taken as indicated by line 5—5 on FIG. 4.

Referring to FIGS. 1 and 4 of the drawings, at least one stall-strip projects from the top surface of the shell S, in the form of a transverse ridge R. As shown, there is a pair of transversely aligned ridges R and one at each side of the helmet. And preferably, there are two pairs of transversely aligned ridges R, so that said ridges occur in tandem at each top side of the helmet. Through empirical design and testing, the ridges R that are proportioned as shown in the drawings function most satisfactorily when associated with and combined with the interior air vents as shown. In practice, there are two ridges R of 2.375 inch transverse extent, followed by two ridges R of 1.875 inch transverse extent. The tandem ridges are spaced 1.5 inch apart, and they are related to the outer top contour 15 of the helmet as best shown in FIG. 4. In practice, the ridges R project above contour 15 about 0.100 inch to about 0.150 inch, and having an entry ramp 16 inclined at about 30°, and having a re-entry ramp 17 declined at about 45°. The ridge peak is slightly rounded, and the ramps 16 and 17 are essentially flat, though they may be slightly arcuate in plan form as indicated in the drawings.

In accordance with this invention, the aerodynamic effect of the stall-strip ridges R is enhanced by venting interior helmet air up the entry ramp 16 to discharge over the ridge in spaced relation to the top contour 15. Accordingly, there is a transverse slot-shaped vent 18 contiguous to and ahead of each entry ramp 16, said vent 18 opening from the space between the shell S and head of the wearer and with walls slanted to discharge upwardly and rearwardly over the ramp. Each ramp 16 extends forwardly from the peak of its ridge R and to a front lip 19 spaced below the top contour 15 (see FIG. 4) whereby discharge of interior helmet air is turned rearwardly. The high velocity air flowing over the top contour 15 of the helmet has a suction effect on the entry ramp-vent configuration as thus far described, whereby interior helmet air is pumped over the ridges R for its discharge into the boundary layer of air trailing over the re-entry portion y of the helmet. The result is a steadying effect that reduces and/or eliminates buffeting of the helmet when subjected to high wind velocities, even under turbulent conditions.

A controlled source of interior helmet air is provided for the vents 18, and to this end the liner L is manifolded as will now be described. FIG. 2 of the drawings illustrates the right and left distribution of frontal air through inlet ports 20 and 21, via channels 22 and 23 to the rear of the helmet liner L and then forwardly via a Y-shaped channel 24 to right and left discharge ports 25 and 26. The inlet ports 20 and 21 are horizontally disposed slot-shaped openings in the shell S, controlled by shutters 27 and 28 accessible by means of protruding buttons at the front exterior brow portion of the helmet. A fabric lining 29 interfaces the head of the wearer with the interior of the liner L, the channels 22–24 being open to and closed off by the lining so as to ventilate the head and scalp of the wearer.

FIG. 3 of the drawings illustrates the right and left groupings of manifolding that supplies interior helmet air to the ridges R. As shown, the Y-shaped channel 24 delivers air to exterior channels 30 and 31 via the right and left discharge ports 25 and 26. In practice, the channels 30 and 31 are H-shaped so as to underlie the tandem related ridge vents 18 (see FIG. 4). Accordingly, the controlled discharge of interior helmet air is through the vents 18 and over the entry ramps 16 into the boundary layer air that travels over the re-entry portion y of the helmet. The resulting effect is the reduction and/or elimination of undesirable buffeting of the safety helmet at high wind velocities.

Having described only the typical and preferred form and application of my invention, I do not wish to be limited or restricted to the specific details herein set forth, but with to reserve to myself any modifications or variations that may appear to those skilled in the art, as set forth within the limits of the following claims.

I claim:

1. An anti buffeting ventilated helmet for use in high velocity wind conditions and including;

a dome-shaped shell for protectively enclosing a wearer's head with space for ventilation therebetween and having a transparent window completely shielding and enclosing the face of the wearer and having a longitudinally cambered exterior top surface with an entry portion extending rearwardly from said window and continuing into a re-entry portion, means admitting ventilating air to said space for circulation within the shell, there being at least one stall-strip comprised of an inclined entry ramp and a declined re-entry ramp and projecting from said exterior top surface of the shell in the form of a transverse ridge ahead of said re-entry portion of the shell, and an opening from said space for circulation of ventilating air through the entry portion of the shell ahead of the transverse ridge and discharging air from said space within the shell and onto said inclined entry ramp and over said transverse ridge, whereby the boundary layer of air trailing over the re-entry portion is added to and disturbed so as to reduce lift and buffeting.

2. The anti buffeting hemet as set forth in claim 1, wherein there is a pair of transversely spaced transverse ridges and openings ahead of said re-entry portion.

3. The anti buffeting helmet as set forth in claim 1, wherein there are transverse ridges and openings spaced longitudinally of said exterior top surface.

4. The anti buffeting helmet as set forth in claim 1, wherein there are pairs of transversely spaced transverse ridges and openings spaced longitudinally of said exterior top surface.

5. The anti buffeting helmet as set forth in claim 1, wherein the entry ramp is inclined at substantially 30° followed by the re-entry ramp declined at substantially 45°.

6. The anti buffeting helmet as set forth in claim 5, wherein said opening through the shell discharges interior helmet air onto said inclined ramp below the exterior top surface of the shell.

7. The anti buffeting helmet as set forth in claim 1, wherein the entry ramp is extended to a ridge spaced above the said top surface of the shell and inclined at substantially 30°, followed by the re-entry ramp extended from said ridge to the said top surface of the shell and declined at substantially 45°.

8. The anti buffeting helmet as set forth in claim 7, wherein said opening through the shell discharges interior helmet air onto said inclined ramp below the exterior top surface of the shell.

9. The anti buffeting helmet as set forth in claim 1, wherein the longitudinal extent of said re-entry portion exceeds that of the entry portion.

10. The anti buffeting helmet as set forth in claim 1, wherein the entry portion occupies substantially 40% of and the re-entry portion occupies substantially 60% of the longitudinal extent of the top surface and camber of the helmet.

11. An anti buffeting ventilated helmet for use in high velocity wind conditions and including:

a dome-shaped shell protectively enclosing a wearer's head with space for ventilation therebetween and having a longitudinal cambered exterior top surface with an entry portion continuing into a re-entry portion, a shock absorbing liner occupying said space between the shell and the wearer's head and with its exterior interfaced with the interior of the shell and having at least one channel for air distribution, means admitting ventilation air through the shell and to said at least one channel in the liner and to a discharge port, there being at least one stall-strip projecting from said exterior top surface of the shell and in the form of a transverse ridge ahead of said re-entry portion of the shell, and an opening from said discharge port and through the entry portion of the shell ahead of the transverse ridge and discharging interior air over said transverse ridge, whereby the boundary layer of air trailing over the re-entry portion is added to and disturbed so as to reduce lift and buffeting.

12. The anti buffeting helmet as set forth in claim 11, wherein the means admitting ventilation air includes shutter means accessible for manipulation at the exterior of the shell.

13. The anti buffeting helmet as set forth in claim 11, wherein said at least one channel is open at the interior of the shell and to the interior of the helmet and with an inlet port through the liner and to the means admitting ventilating air through the shell.

14. The anti buffeting helmet as set forth in claim 13, wherein a breathing fabric lining is interfaced with the head of the wearer and with the interior of the liner for ventilating the head of the wearer.

* * * * *